US011766590B2

(12) United States Patent
Olson et al.

(10) Patent No.: US 11,766,590 B2
(45) Date of Patent: Sep. 26, 2023

(54) SQUAT RACK MOUNTABLE DIP EXERCISING SYSTEM

(71) Applicants: Zachary Scott Olson, Owatonna, MN (US); Joseph Michael Kenow, Owatonna, MN (US); Bret Michael Contreras, Las Vegas, NV (US)

(72) Inventors: Zachary Scott Olson, Owatonna, MN (US); Joseph Michael Kenow, Owatonna, MN (US); Bret Michael Contreras, Las Vegas, NV (US)

( * ) Notice: Subject to any disclaimer, the term of this patent is extended or adjusted under 35 U.S.C. 154(b) by 176 days.

(21) Appl. No.: 17/543,846

(22) Filed: Dec. 7, 2021

(65) Prior Publication Data

US 2023/0173340 A1 Jun. 8, 2023

(51) Int. Cl.

| | |
|---|---|
| ***A63B 23/12*** | (2006.01) |
| ***A63B 21/00*** | (2006.01) |
| ***A63B 23/035*** | (2006.01) |
| ***A63B 71/00*** | (2006.01) |
| *A63B 23/04* | (2006.01) |

(52) U.S. Cl.

CPC .... *A63B 23/1227* (2013.01); *A63B 21/00047* (2013.01); *A63B 21/4035* (2015.10); *A63B 23/03525* (2013.01); *A63B 71/0054* (2013.01); *A63B 2023/0411* (2013.01); *A63B 2225/093* (2013.01)

(58) Field of Classification Search

CPC ..... A63B 21/00047; A63B 21/068; A63B 21/0783; A63B 21/4035; A63B 23/03525; A63B 23/0405; A63B 23/1227; A63B 71/0054; A63B 2023/0411; A63B 2225/093

See application file for complete search history.

(56) References Cited

U.S. PATENT DOCUMENTS

| | | | | |
|---|---|---|---|---|
| 4,537,395 | A | 8/1985 | Spinelli | |
| 6,217,483 | B1 | 4/2001 | Kallassy | |
| 8,936,537 | B2 | 1/2015 | Hoole | |
| 9,302,136 | B2 | 4/2016 | Lyszczarz | |
| 9,630,046 | B2 | 4/2017 | Childs | |
| 10,052,517 | B2 * | 8/2018 | Critelli | A63B 21/068 |
| 10,576,322 | B2 * | 3/2020 | Schlegel | A63B 23/1227 |
| 10,987,532 | B2 | 4/2021 | Lawton | |
| 11,007,392 | B2 * | 5/2021 | Schlegel | A63B 23/1227 |
| 2009/0072111 | A1 * | 3/2009 | Piane, Jr. | A63B 69/222 248/309.1 |
| 2010/0105532 | A1 * | 4/2010 | Israeli | A63B 1/00 482/131 |
| 2010/0227743 | A1 * | 9/2010 | Jutte | A63B 69/222 482/142 |
| 2014/0135182 | A1 * | 5/2014 | Inglut | A63B 23/1227 482/96 |
| 2014/0135183 | A1 * | 5/2014 | Inglut | A63B 23/1227 482/96 |

(Continued)

FOREIGN PATENT DOCUMENTS

| | | |
|---|---|---|
| WO | WO9964114 | 12/1999 |

*Primary Examiner* — Joshua Lee

(57) ABSTRACT

A squat rack mountable dip exercising system includes a frame that is removably positionable on and extended between a first guard and a second guard wherein the first and second guards are engaged with and extend forwardly from a squat rack. A grip is attached to the frame and is configured to be graspable by a person performing a dip exercise.

20 Claims, 5 Drawing Sheets

(56) References Cited

U.S. PATENT DOCUMENTS

| | | | | |
|---|---|---|---|---|
| 2018/0243597 | A1* | 8/2018 | Schlegel | A63B 23/047 |
| 2019/0388721 | A1* | 12/2019 | Schlegel | A63B 69/34 |
| 2021/0106862 | A1 | 4/2021 | Thomas | |

* cited by examiner

SQUAT RACK MOUNTABLE DIP EXERCISING SYSTEM

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to dip exercising device and more particularly pertains to a new dip exercising device for attachment to a squat rack at a selectable height and which utilizes conventional weight guards of a squat rack to provide stability to the dip exercising device.

(2) Description of Related Art Including Information Disclosed Under 37 CFR 1.97 and 1.98

The prior art relates to dip exercising devices that are attachable to other exercising devices. However, these devices typically include a single bracket that is engageable, for instance, with squat rack, or other means of attachment which do not offer enough stability while performing dip exercises.

BRIEF SUMMARY OF THE INVENTION

An embodiment of the disclosure meets the needs presented above by generally comprising a frame that configured for being removably positionable on and extended between a first guard and a second guard wherein the first and second guards are engaged with and extend forwardly from a squat rack. A grip is attached to the frame and is configured to be graspable by a person performing a dip exercise.

In another embodiment, the disclosure includes a squat rack having first and second guards mounted thereon and extending forwardly of the squat rack. A frame is removably positioned on and extended between the first and second guards. A grip is attached to the frame and is configured to be graspable by a person performing a dip exercise.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
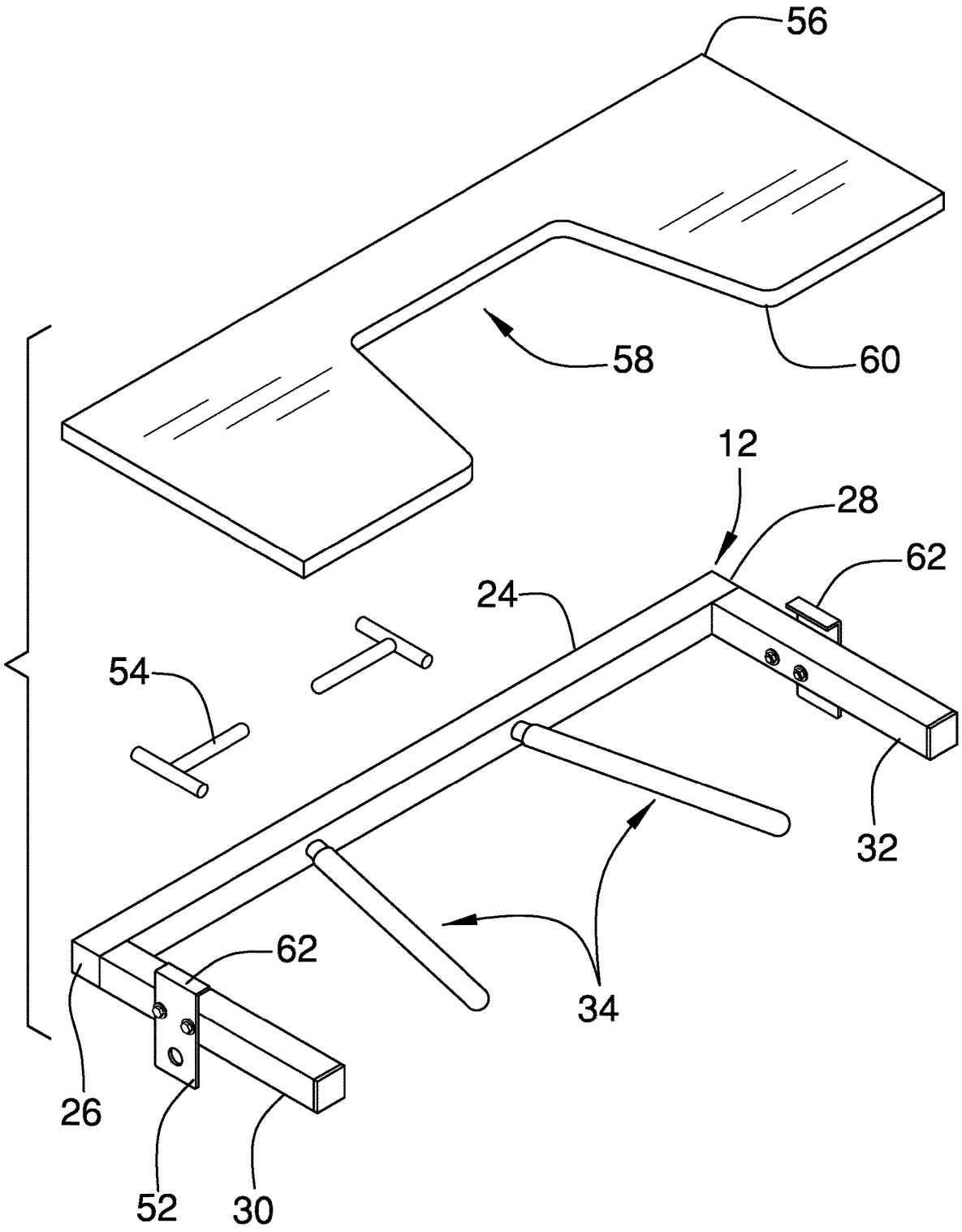
FIG. 1 is a top isometric exploded view of a squat rack mountable dip exercising system according to an embodiment of the disclosure.

With reference now to the drawings, and in particular to FIGS. 1 through 6 thereof, a new dip exercising device embodying the principles and concepts of an embodiment of the disclosure and generally designated by the reference numeral 10 will be described.

Figure 4:
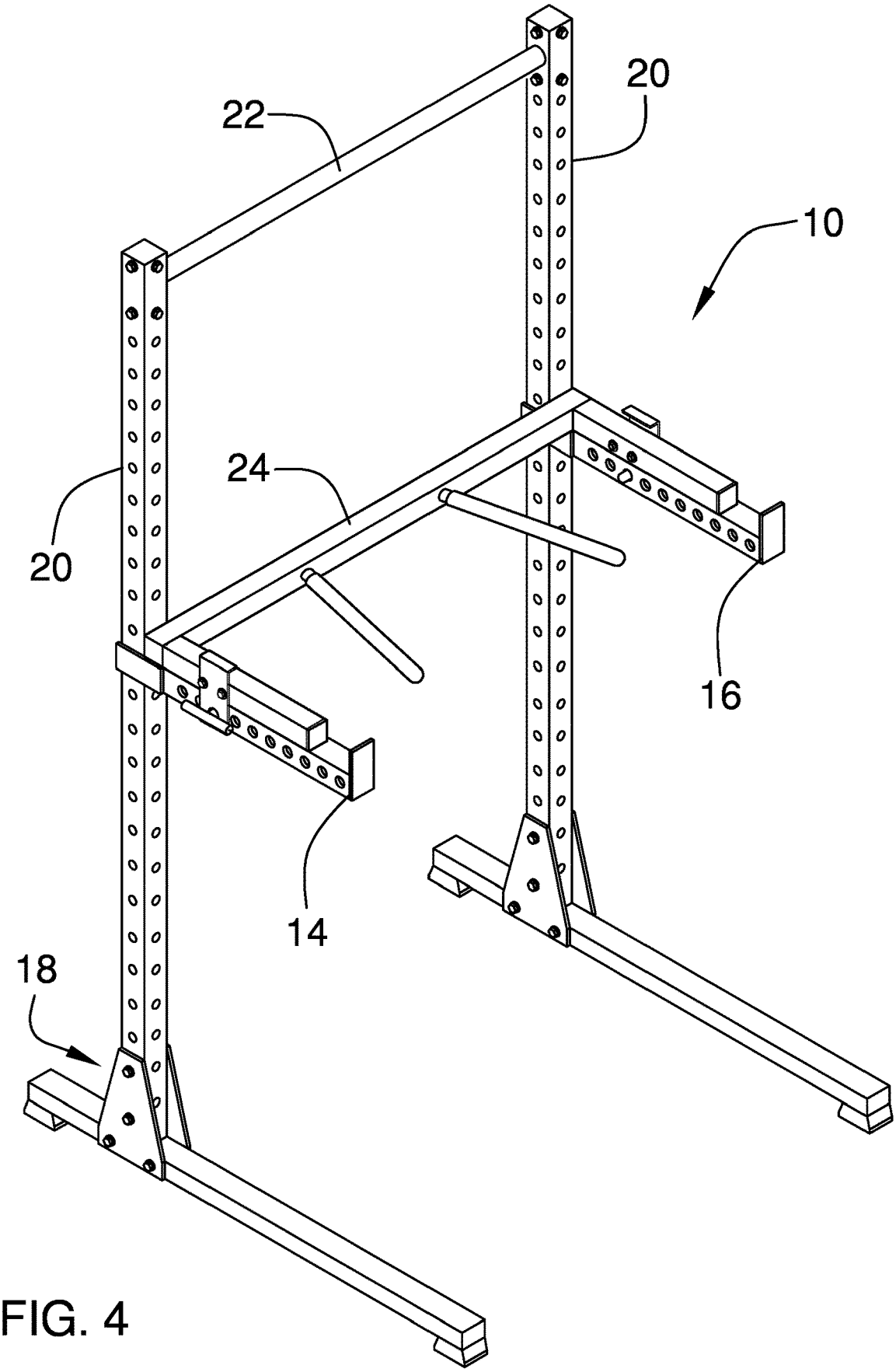
FIG. 4 is a front isometric view of an embodiment of the disclosure.
Figure 5:
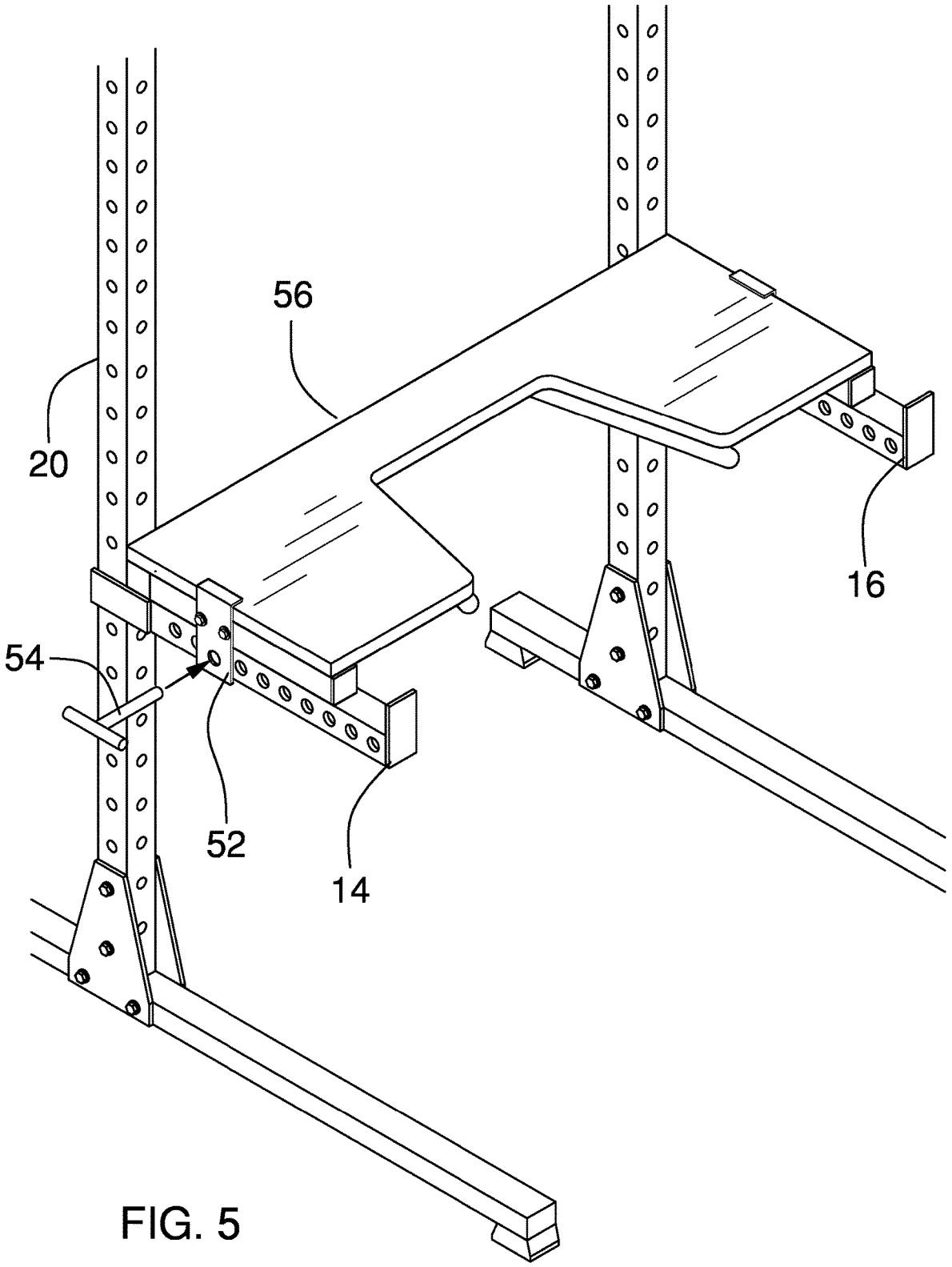
FIG. 5 is a front isometric view of an embodiment of the disclosure.

As best illustrated in FIGS. 1 through 6, the squat rack mountable dip exercising system 10 generally includes a frame 12 that is removably positionable on and extended between a first guard 14 and a second guard 16 wherein the first 14 and second 16 guards are engaged with and extend forwardly from a squat rack 18. The term "forwardly" used herein for ease of reference only as the first 14 and second 16 guards may be extended in an opposite direction and is relative typically to a user of the system 10 as the first 14 and second 16 guards will be extending toward the user. The squat rack 18 is conventional and includes at least a pair of vertically orientated posts 20 wherein a bar 22 may extend between the posts 20. The posts 20 each include a plurality of openings to allow various devices to be removably attached to the posts 20 and which are often used for supporting guards 14, 16 as shown in FIG. 4. The first 14 and second 16 guards are used during exercises, for example, to retain a barbell having weights thereon at least above a chosen height. This retention above a particular height helps to prevent injuries to person using the squat rack for doing squats and other types of lifting exercising. The first 14 and second 16 guards are conventional and be positioned at any desired height along the posts 20. Though not shown, the squat rack 18 may include another type of conventional rack that includes four vertically orientated posts 20 wherein there are two front posts and two rear posts. For these types of squat racks, the first 14 and second 16 guards are usually attached to and extend between the front and rear posts whereupon the first 16 and second 18 guards lie in a horizontal plane and are orientated parallel to each other. Thus, the type of rack used for the system 10 is not germane to the functionality of the system 10 so long as the first 14 and second 16 guards have at least two posts to be mounted upon such that the first 14 and second 16 guards laterally spaced and orientated parallel to each other.

The frame 12 includes a central member 24 that is laterally elongated and has a first end 26 and a second end 28. The central member 24 has a length from the first end 26 to the second end 28 that will typically be between 40 inches and 90 inches and more particularly will be generally equal, that is within 1.5 inches, to a distance between the outside edges of the first 14 and second 16 guards. The central member 24 may be curved but will typically be straight from the first end 26 to the second end 28. A first stabilizer 30 and a second stabilizer 32 are each is attached to the central member 24. Each of the first 30 and second 32 stabilizers are positionable on one of the first 14 and second 16 guards to stabilize the central member 24 relative to the first 14 and second 16 guards. Each of the first 30 and second 32 stabilizers extends away from the central member 24 in a same direction with respect to each other. The first stabilizer 30 is positioned adjacent to the first end 26 and the second stabilizer 32 is positioned adjacent to the second end 28. Each of the first 30 and second 32 stabilizers may comprise an elongated shaft that is orientated perpendicular to the central member 24 and extends away from the central member 24 a distance of between 6 inches and 36 inches.

Alternate configurations of the frame 12 may be utilized. For example, the first 30 and second 32 stabilizers may be attached to the central member 24 in an "I" configuration wherein the central member 24 only extends to the inner edges of the first 14 and second 16 guards. The first 30 and second 32 stabilizers in such a configuration would still be positioned on the first 14 and second 16 guards as shown in FIG. 4. Yet another embodiment may include the central member 24 having a length such that the first 30 and 32 second stabilizers are positioned between the first 14 and second 16 guards and brackets, extending from the first 30 the second 32 stabilizers, engage the first 14 and second 16 guards such that the first 30 and second 32 stabilizers and central member 24 all lie within a plane extending through the first 14 and second 16 guards. However, positioning of the first 30 and second 32 stabilizers upon the first 14 and second 16 guards will allow for a cost effective and stable system 10.

Figure 2:
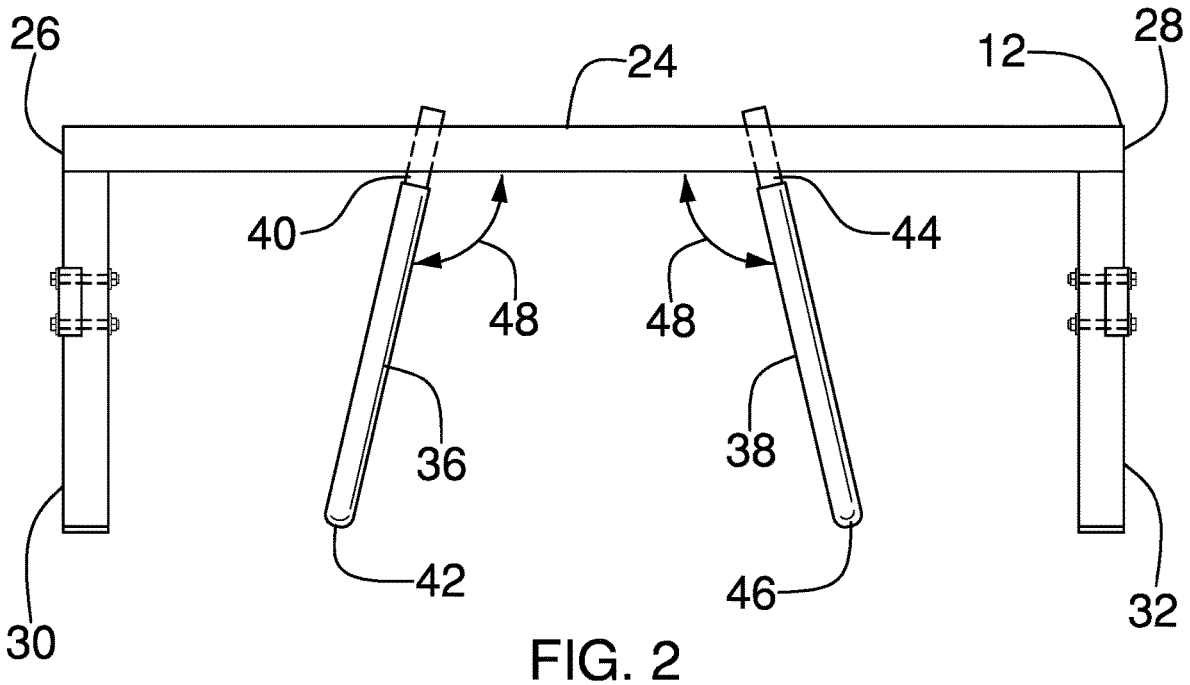
FIG. 2 is a top view of an embodiment of the disclosure.
Figure 3:
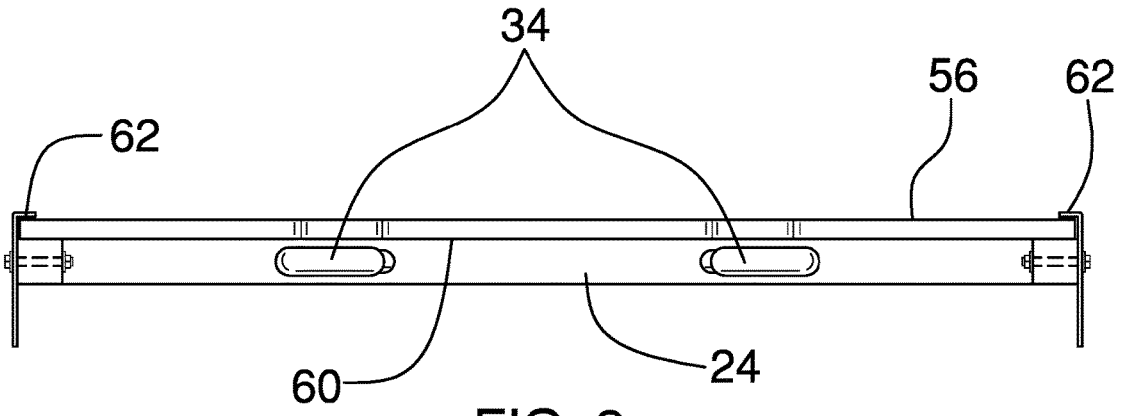
FIG. 3 is a front view of an embodiment of the disclosure.

A grip 34 is attached to the frame 12 and is configured to be graspable by a person performing a dip exercise. The grip 34 is attached to the central member 24 of the frame 12 and extends away from the central member 24 in a same direction as the first 30 and second 32 stabilizers. The grip 34 may be positioned within a plane extending through the first 30 and second 32 stabilizers, though the grip 34 may extend downwardly and forwardly from the central member 24 below the plane of the first 30 and second 32 stabilizers. In one embodiment, the grip 34 comprises a first handle 36 and a second handle 38 each attached to the central member 24. As shown in FIG. 2, the first handle 36 has a proximal end 40 and a distal end 42 with respect to the central member 24 and the second handle 38 has a proximal end 44 and a distal end 46 with respect to the central member 24. The first 36 and second 38 handles each comprise a tubular shape and extend away from the central member 24 a distance of between 6 inches and 24 inches. The proximal ends 40, 44 are laterally spaced from each other a distance of between 8 inches and 36 inches. The first 36 and second 38 handles form internal angles 48 with the central member 24 that face each other. The internal angles 48 are each equal to or greater than 90° such that a distance between the proximal ends 40, 44 is equal to or less than a distance between the distal ends 42, 46. The internal angle is typically no greater than 135° and a distance between the distal ends 42, 46 is between 16 inches and 30 inches. It should be understood that the above is only one configuration of the grip 34. Other variations, typically used for dip exercises, such as a single rod being attached to a "U" shaped grip may also be utilized.

A pair of securing members 50 is configured to releasably engage the frame 12 to the first 14 and second 16 guards. Generally, the securing members 50 are used to prevent the frame 12 from laterally moving relative to the first and 14 second 16 guards. Each of the securing members 50 may include a bracket 52 and a pin 54. Each of the first 30 and second 32 stabilizers has one of the brackets 52 attached thereto and extending downwardly therefrom. In one embodiment the brackets 52 are plates positioned on the outside lateral edges of the first 30 and second 32 stabilizers to position the first 14 and second 16 guards between the plates of the brackets 52. Each of the pins 54 is extendable through an associated one of the brackets 52 and an adjacently positioned one of the first 14 and second 16 guards. The pins 54 prevent forward and rearward movement of the frame 12 relative to the squat rack 18.

A platform 56 is positionable on the frame 12 such that it extends between the first 30 and second 32 stabilizers and the grip 34 is positioned below the platform 56. The frame 12, including the first 30 and second 32 stabilizers and the central member 24, abut a bottom side 60 of the platform 56 to provide rigidity to allow a person to stand on the platform 56. In such a position, different exercises may be accomplished wherein the weight is positioned below the platform 56 and lifted upwardly from that location. To further facilitate these exercises, the platform 56 may include a cutout 58 for allowing weights or tethers secured to weights, for example, to move upwardly between a person's feet. The grip 24 may also be positioned against the bottom side 60 of the platform 56 to add additional stability to the platform 56. A pair of receivers 62 may be provided and each of the first 30 and second 32 stabilizers has one of the receivers attached thereto. The platform 56 engages the receivers 62 to stabilize lateral movement of the platform 56 on the first 30 and second 32 stabilizers. As shown in FIG. 1, the receivers 62 may comprise shoulders that are attached to the brackets 52 and extend above the first 30 and second 32 stabilizers.

Figure 6:
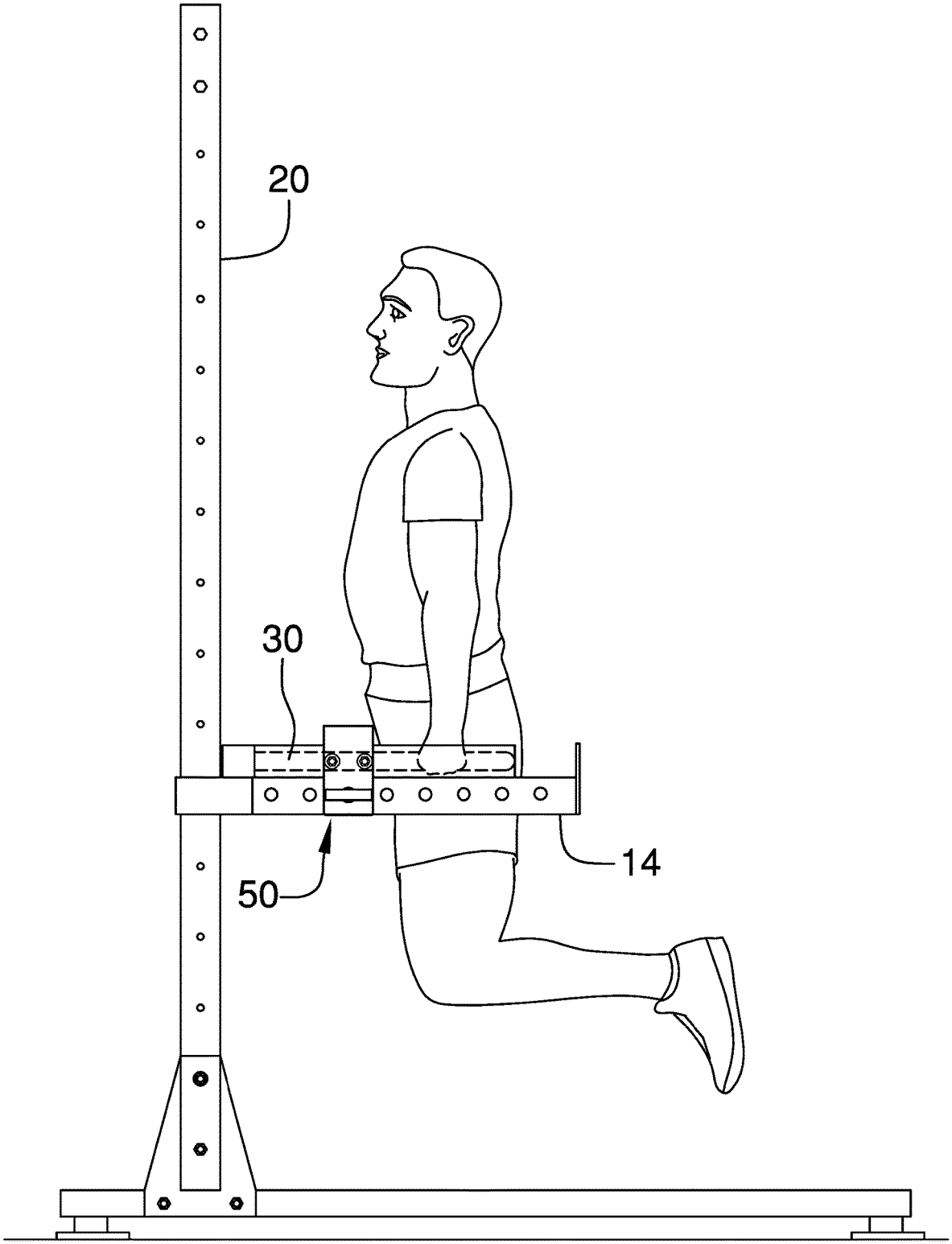
FIG. 6 is a side-use view of an embodiment of the disclosure.

In use, the frame 12 is positioned on the first 14 and second 16 conventional guards of a squat rack 18 such that the grip 34 is positioned at a correct height for performing dip exercises. The grip 34 is then used to perform dips as is shown in FIG. 6. If desired, the platform 56 may be positioned on the frame 12 to allow for additional exercises by a person standing on the platform 56.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

We claim:

1. A rack mountable exercising assembly comprising:

a frame configured for being removably positionable on and extended between a first guard and a second guard wherein the first and second guards are engaged with and extend forwardly from a squat rack; and a grip being attached to the frame, the grip being configured to be graspable by a person performing a dip exercise.

2. The rack mountable exercising assembly according to claim 1, wherein the frame includes:

a central member being laterally elongated and having a first end and a second end; and a first stabilizer and a second stabilizer each being attached to the central member, each of the first and second stabilizers being positionable on one of the first and second guards to stabilize the central member relative to the first and second guards.

3. The rack mountable exercising assembly according to claim 2, wherein the central member has a length from the first end to the second end being between 40 inches and 90 inches.

4. The rack mountable exercising assembly according to claim 3, wherein the central member is straight from the first end to the second end.

5. The rack mountable exercising assembly according to claim 2, wherein each of the first and second stabilizers extends away from the central member in a same direction with respect to each other.

6. The rack mountable exercising assembly according to claim 5, wherein the first stabilizer is positioned adjacent to the first end and the second stabilizer is positioned adjacent to the second end.

7. The rack mountable exercising assembly according to claim 5, wherein each of the first and second stabilizers comprises an elongated shaft being orientated perpendicular to the central member and extending away from the central member a distance of between 6 inches and 36 inches.

8. The rack mountable exercising assembly according to claim 5, wherein the grip is attached to the central member of the frame.

9. The rack mountable exercising assembly according to claim 8, wherein the grip extends away from the central member in a same direction as the first and second stabilizer.

10. The rack mountable exercising assembly according to claim 9, wherein the grip is positioned within a plane extending through the first and second stabilizers.

11. The rack mountable exercising assembly according to claim 2, wherein the grip is attached to the central member of the frame.

12. The rack mountable exercising assembly according to claim 11, wherein the grip is positioned within a plane extending through the first and second stabilizers.

13. The rack mountable exercising assembly according to claim 12, wherein the grip comprises:

a first handle and a second handle each being attached to the central member;

the first handle having a proximal end and a distal end with respect to the central member;

the second handle having a proximal end and a distal end with respect to the central member; and the first and second handles each comprising a tubular shape and extending away from the central member a distance of between 6 inches and 24 inches.

14. The rack mountable exercising assembly according to claim 13, wherein the grip further comprises:

the proximal ends being laterally spaced from each other a distance of between 8 inches and 36 inches; and the first and second handles forming internal angles with the central member that face each other, the internal angles each being an angle equal to or greater than 90° such that a distance between the proximal ends is equal to or less than a distance between the distal ends.

15. The rack mountable exercising assembly according to claim 2, further including a pair of securing members being configured to releasably engage the frame to the first and second guards.

16. The rack mountable exercising assembly according to claim 15, wherein each of the securing members includes a bracket and a pin, each of the first and second stabilizers having one of the brackets attached thereto, each of the pins being extendable through an associated one of the brackets and an adjacently positioned one of the first and second guards.

17. The rack mountable exercising assembly according to claim 15, further including:

a platform being positionable on and extending between the first and second stabilizers, the grip being positioned below the platform; and a pair of receivers, each of the first and second stabilizers having one of the receivers attached thereto, the platform engaging the receiver to stabilize lateral movement of the platform on the first and second stabilizers.

18. The rack mountable exercising assembly according to claim 17, wherein the grip is positioned within a plane extending through the first and second stabilizers, the grip further including;

a first handle and a second handle each being attached to the central member;

the first handle having a proximal end and a distal end with respect to the central member;

the second handle having a proximal end and a distal end with respect to the central member; and the first and second handles each comprising a tubular shape and extending away from the central member a distance of between 6 inches and 24 inches.

19. The rack mountable exercising assembly according to claim 18, wherein each of the first and second stabilizers extends away from the central member in a same direction with respect to each other, the first stabilizer is positioned adjacent to the first end and the second stabilizer is positioned adjacent to the second end, and wherein each of the first and second stabilizers comprises an elongated shaft being orientated perpendicular to the central member and extending away from the central member a distance of between 6 inches and 30 inches.

20. The rack mountable exercising assembly according to claim 2, further including:

a platform being positionable on and extending between the first and second stabilizers, the grip being positioned below the platform; and a pair of receivers, each of the first and second stabilizers having one of the receivers attached thereto, the platform engaging the receiver to stabilize lateral movement of the platform on the first and second stabilizers.

* * * * *